US005788816A

United States Patent [19]

Steckenreuter et al.

[11] Patent Number: 5,788,816

[45] Date of Patent: Aug. 4, 1998

[54] DEVICE FOR THE PRODUCTION OF MULTIPLE LAYERED PAPER OR CARDBOARD

[75] Inventors: Heinz Steckenreuter; Helmut Stoerr, both of Ravensburg, Germany

[73] Assignee: Voith Sulzer Papiermaschinen GmbH, Heidenheim, Germany

[21] Appl. No.: 703,571

[22] Filed: Aug. 23, 1996

[30] Foreign Application Priority Data

Aug. 23, 1995 [DE] Germany ..... 195 30 983.9

[51] Int. Cl.[6] ..... D21F 11/04

[52] U.S. Cl. ..... 162/304; 162/301; 162/303

[58] Field of Search ..... 162/304, 303, 162/301, 300

[56] References Cited

U.S. PATENT DOCUMENTS

| | | | |
|---|---|---|---|
| 3,915,791 | 10/1975 | Langdon | 162/303 |
| 3,985,612 | 10/1976 | Watanabe | 162/303 |
| 4,430,159 | 2/1984 | Bubik et al. | 162/292 |
| 5,074,964 | 12/1991 | Partanen | 162/301 |
| 5,167,770 | 12/1992 | Bubik et al. | 162/301 |
| 5,259,929 | 11/1993 | Bubik et al. | 162/301 |
| 5,389,206 | 2/1995 | Buck et al. | 162/301 |
| 5,607,555 | 3/1997 | Grossman et al. | 162/304 |

FOREIGN PATENT DOCUMENTS

| | | | |
|---|---|---|---|
| 31 20 073 A1 | 5/1981 | Germany | D21F 9/02 |
| 4402273 | 6/1994 | Germany . | |

OTHER PUBLICATIONS

Schmidt et al. "Former fur die Herstellung mahrlagiger Bahnen", Wochenblatt für Papierfabrikation, 23/24, 1977, pp. 975–980.

*Primary Examiner*—Karen M. Hastings
*Attorney, Agent, or Firm*—Taylor & Associates, P.C.

[57] ABSTRACT

A gap former, consisting of a double sieve former 3 which is made up by an inner sieve 4 and an outer sieve 5, is in the initial stage of the process wrapped around a roller press 8 with a diameter of at least 800 mm. After the sieves have traveled such that a given segment of the sieves is no longer in contact with the roller press, the segment enters between a number of contour brackets 10 and 11 at which time the segment is moving rather steeply downward. During this stage an upper layer 6 of paper or cardboard which has been compressed is deposited onto a lower layer 7 that is already resting on the primary longitudinal sieve 2.

15 Claims, 4 Drawing Sheets

DEVICE FOR THE PRODUCTION OF MULTIPLE LAYERED PAPER OR CARDBOARD

BACKGROUND OF THE INVENTION

1. Field of the Invention.

The present invention relates to a device for the production of multiple layered paper or cardboard (or carton).

2. Description of the Related Art.

A device for the production of multiple layered paper or cardboard is advantageous because the layers can be formed separately. Under some circumstances, especially multiple layered carton, the multiple layered paper or cardboard can display a low resistance to cleavage fracture, i.e., delamination of the layers from one another. In addition, the double-sieve formers which are stacked on top are rather complex devices and are very demanding regarding space and energy.

SUMMARY OF THE INVENTION

The present invention provides a device for the production of multiple layered paper or cardboard with much less effort and complexity to provide a high resistance to cleavage or delamination fracture of the multiple layered paper or cardboard.

The concept of this invention has the fundamental advantage that the roller presses produce optimum lamina. Furthermore, the centrifugal forces acting around the roller presses cause the fine particles to couch very early against what will later be the couch side of the upper layer. The subsequent segment of double sieves and contour brackets (to define the sieve's path) declines at a rapid rate which allows water to be removed. Within these brackets, no negative pressure or just a slight negative pressure needs to be applied to remove water since the falling stream requires only to be guided gently into the right direction. The molding is easy to control and requires only very little energy. These rather simple means accomplish the joining of the upper and lower layers with a high amount of resistance against delamination but without any negative effects on the forming process.

The contour brackets in the declining segment of the double sieve mold can be attached to either one or both sides. Such brackets are commonly pressed against the sieves such that they will shape their contours. This results in pressure and suction acting on the layer of suspended fine particles between the sieves.

The before mentioned fine particles are very important for couching paper or cardboard. Either by varying the applied suction and/or by fine tuning the adjustable contour brackets, these fine particles can be very effectively concentrated in the upper position which is the side that serves for couching.

The surfaces of consecutive brackets facing the sieves can be either straight or convex. According to this invention, removing water at (or with help of) the roller presses can be used to vary the L/Q ratio, i.e., the tensile strength measured along the length direction versus the tensile strength in the cross direction.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
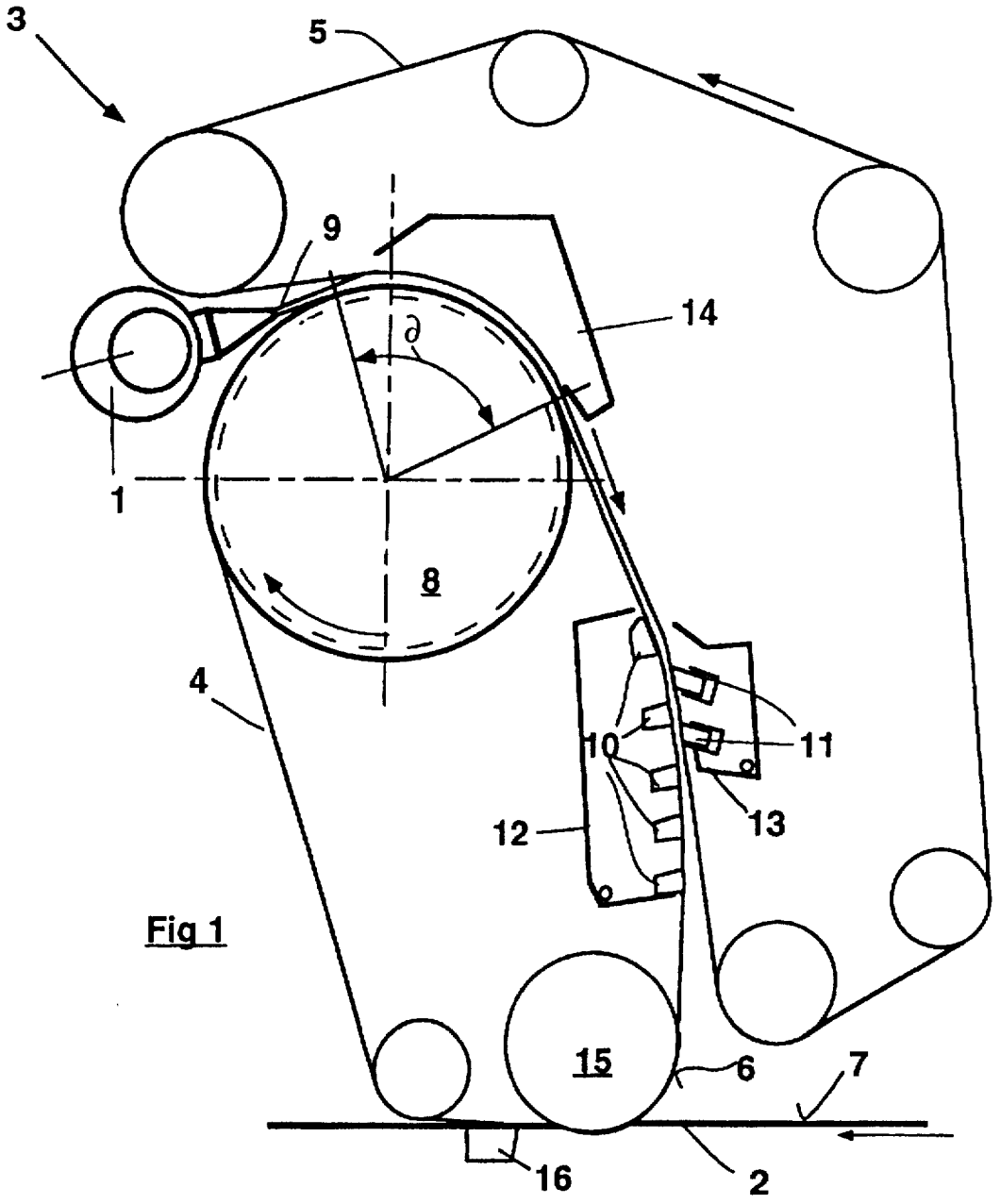
FIG. 1 illustrates an embodiment of a device according to the present invention.

Referring now to the drawings and particularly to FIG. 1, there is shown an embodiment of a double-sieve former 3 of the present invention. An inner sieve 4 and an outer sieve 5 are brought together near the roller press 8. A stream of suspension 9 enters through an inlet 1 near the wedge contour formed by these sieves. Water is removed from both sieves 4 and 5 as well as from the layer of suspension in between them as they move around the roller press 8 along the contact angle $\partial$. Part of this water escapes through the outer sieve 5 and is propelled into the tub 14. After passing the roller press 8, the double-sieve is guided away tangentially, moving generally in a downward direction. Contour brackets or forming blades 10 and 11 are associated with both the inner sieve 4 and the outer sieve 5 of this particular embodiment of the invention. However, brackets are not necessarily required on both sieves. A good alternative would be brackets 11 attached to the outer sieve 5 so that they are flexible and such that they can be elastically supported. Water that penetrates the sieves near these brackets is caught in containers 12 and 13, as it is common for such devices. In special cases it is possible to apply suction to the tub 13 facing the inner sieve 4. This provision is only necessary on a few occasions, and is not generally required. The sieves 4 and 5 separate from one another in directions having oppositely directed horizontal components after they leave behind the guidance of the contour brackets. After the separation therebetween, the layer of compressed fibers is carried by the inner sieve 4. As the inner sieve 4 passes around the next roller 15, the layer of fibers is transferred onto the lower layer 7 which is formed on the primary longitudinal sieve 2. Consecutive depositions result in the formation of multiple layers while the inner sieve 4 is lifting up and returning back to the roller press 8. A suction device 16 can improve the adherence of the layers to the primary longitudinal sieve 2.

Figure 2:
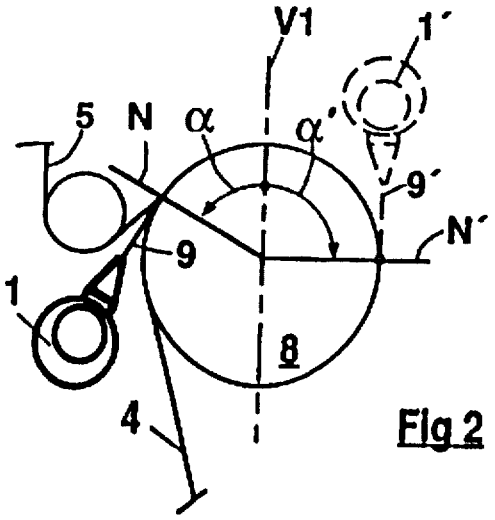
FIG. 2 illustrates the parameters pertaining to the region around the roller press.

FIG. 2 displays the two extreme positions 1 and 1' of pulp suspension entering the device. On the left side of the figure the incoming stream of suspension 9, which forms a plane, is cut by the surface normal N. The surface normal N forms an angle $\alpha$ to the vertical V1 when stream of suspension 9 is aimed at an upward direction as shown at inlet position 1. Angle $\alpha$ does not exceed 60° and in the embodiment shown is approximately 10° when stream of suspension 9 is aimed at a slightly upward direction. The right side of FIG. 2 depicts a vertical stream of suspension 9' whose surface normal N' forms an angle α' with respect to the vertical V1 as shown at inlet position 1'. Angle α' does not exceed 90° in the embodiment shown, whereat stream of suspension 9 is aimed in a downward direction.

Figure 3:
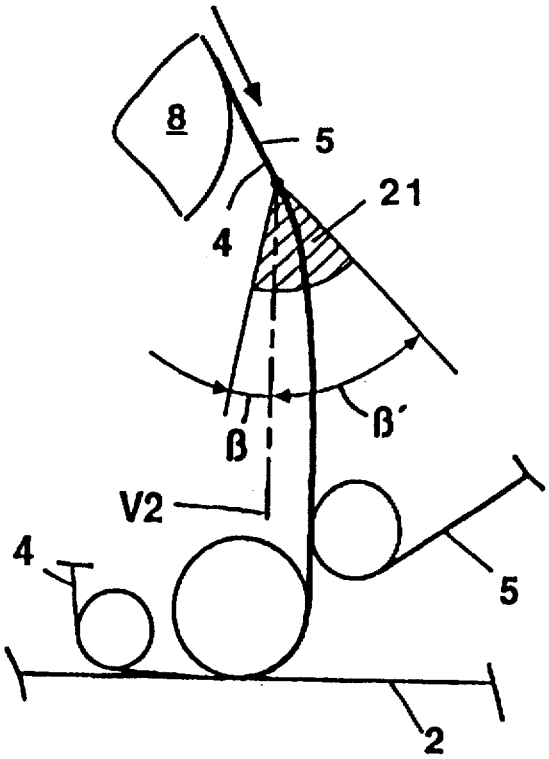
FIGS. 3 and 4 illustrate the parameters pertaining to the region around the double sieves.

FIG. 3 displays the sector 21 which is enclosed by an angle β between the vertical V2 and sieves 4 and 5 when disposed on the side of the inner sieve 4 and an angle β between the vertical V2 and sieves 4 and 5 when disposed on the side of the outer sieve 5. In the embodiment shown, the angle β is preferably not greater than 10° and the angle β is preferably not greater than 45°. After passing the main roller press 8 the sieves 4 and 5 are intended to pass along a trajectory that is within the sector 21.

Figure 4:
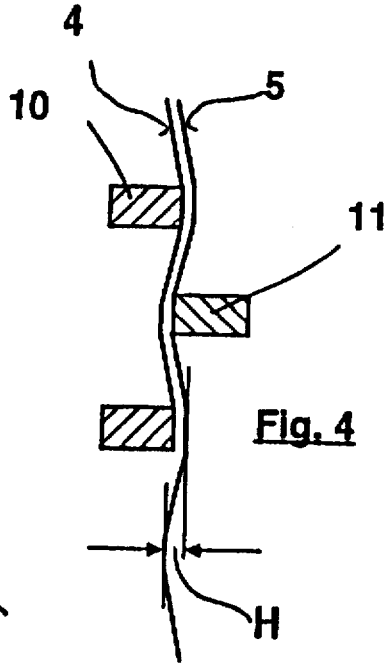

FIG. 4 depicts how the sieves travel along a zig-zag or winding path between the two contour brackets 10 and 11. The schematic illustrates with two arrows the transverse deflection H along the passage of the outer sieve 5 as it is imposed by the two opposing contour brackets 10 and 11 that are in its path.

Figure 5:
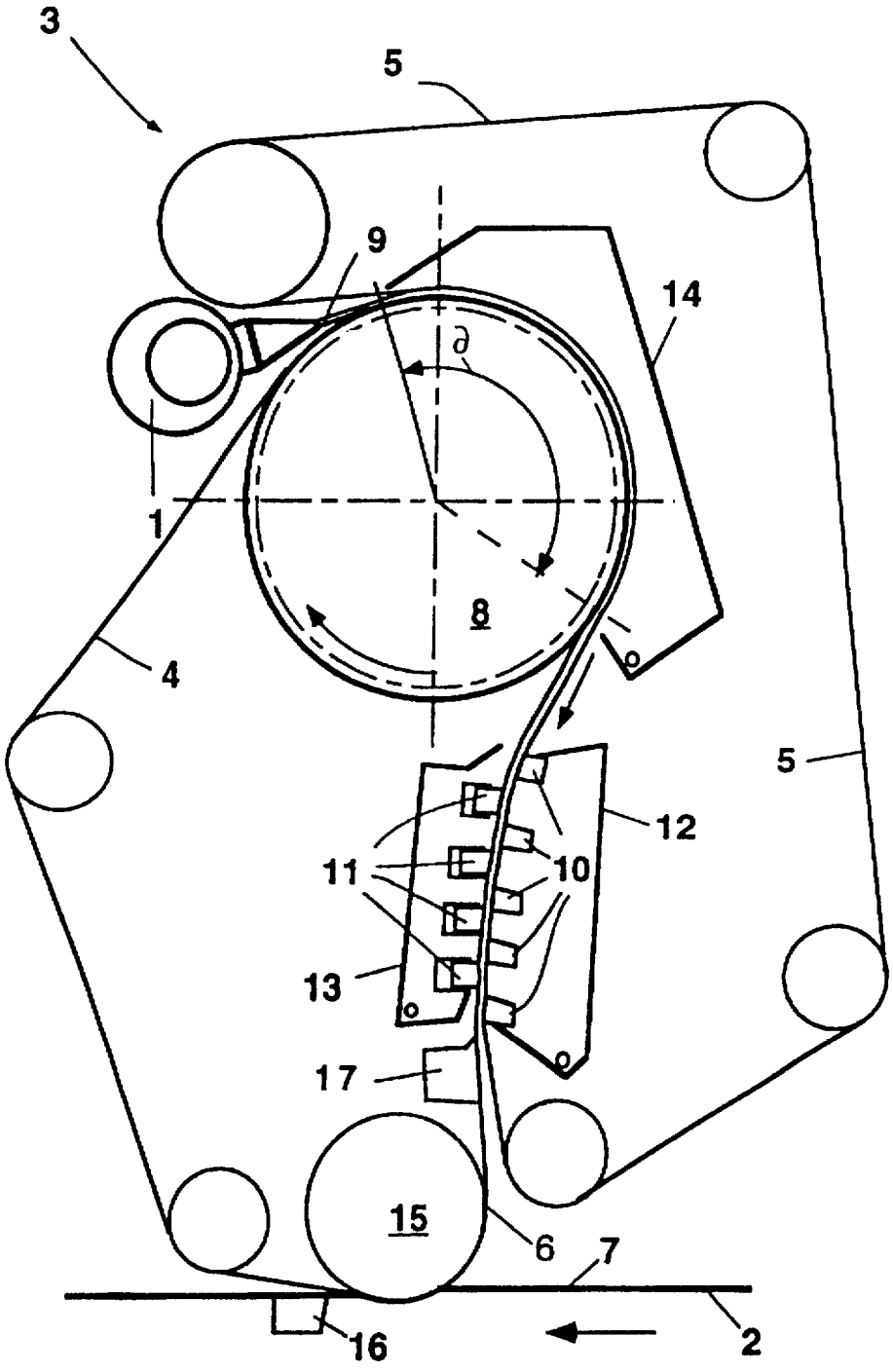
FIGS. 5 and 6 illustrate another embodiment of a device according to the present invention.

Another alternative embodiment of a former of the present invention is depicted in FIG. 5 where the curvature of the contour bracket acting on the sieves is opposite to the curvature of the roller press acting on the sieves. In this version, the layer of fibers 6 that is deposited onto the lower layer 7 is held to the inner sieve 4 just like in the previous version seen in FIG. 1. This particular configuration results in a larger contact arc ∂ along the roller press 8. The contact arc ∂ is preferably between 10° and 180°, and more preferably is between 10° and 100°. Moreover, this configuration is conceived to work with a suction device 17 that is applied to adhere the layer of pulp to the inner sieve.

According to the implementations shown in FIGS. 1 and 5 the upper layer of pressed pulp 6 adheres to the inner sieve 4 after the sieves are separated. The upper layer of pressed pulp 6 is then deposited on top of the lower layer 7. This solution is preferred in most cases.

Figure 6:
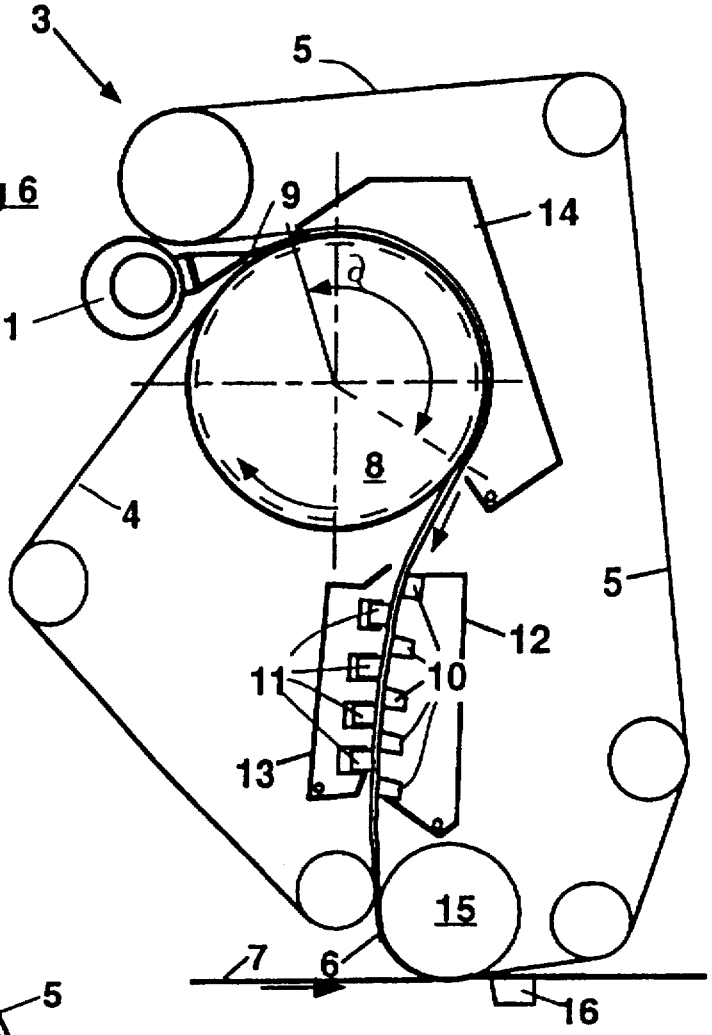

FIG. 6 illustrates how the principal can be reversed so that after the inner sieve 4 is separated from the outer sieve 5, the upper layer of pressed pulp 6 adheres to the outer sieve 5 before it is deposited on top of the lower layer 7.

Figure 7:
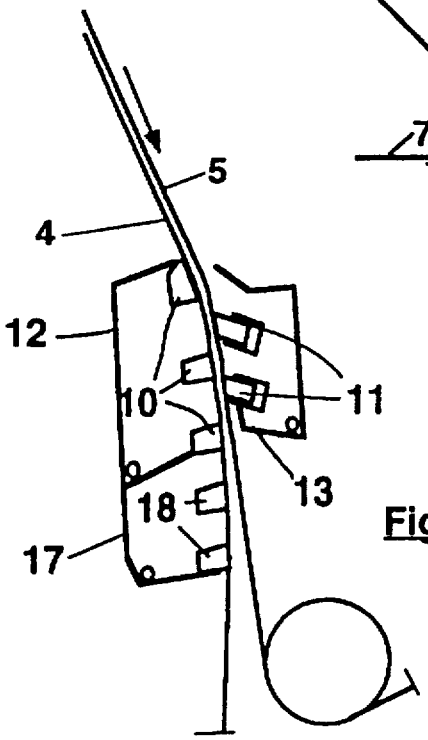
FIG. 7 illustrates another embodiment of a device according to the present invention.

FIG. 7 demonstrates the advantage of the suction device 17 which draws water out of the layer of pressed pulp. Suction device 17 is separate from the other water collection containers 12 and 13 so that it can be put under a low vacuum. The passing sieves are pushed away from the suction chamber by several contour brackets just like the other water collection containers 12 and 13. Suction device 17 applies a vacuum pressure to inner sieve 4 in an area not exceeding 10% of the area of the contour brackets.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for the production of multiple layered paper or cardboard from a fiber suspension, said device comprising:

a roller press having an outer diameter of at least 800 mm;

means for impinging a stream of the fiber suspension on said roller press at an angle between a vertical V1 and a surface normal N to the suspension stream, said angle being represented by an angle α which is not greater than approximately 60° when the suspension stream is aimed in an upward direction and being represented by an angle α' which is not greater than approximately 90° when the suspension stream is aimed in a downward direction;

a primary longitudinal sieve carrying a lower layer of paper or cardboard; and a double-sieve former for forming an upper layer of the multiple layered paper or cardboard, said double-sieve former including an inner sieve and an outer sieve which are disposed close to one another at a portion thereof and thereafter separate from one another with respect to a running direction of the sieves, said inner sieve carried by said roller press, said inner sieve and said outer sieve each being carried by said roller press with a contact arc ∂ which extends at least 10°, said double-sieve former further including a plurality of forming blades associated with each said sieve, said forming blades disposed on both sides of said inner sieve and said outer sieve, said forming blades being consecutively located and alternatingly altering the path of said inner sieve and said outer sieve such that said inner sieve and said outer sieve travel in a zig-zag path with a transverse deflection H of between approximately 0.5 mm to 5.0 mm between said forming blades where both sieves are disposed close to one another, said upper layer adhering to one of the inner sieve and the outer sieve and thereafter being deposited on the lower layer of paper or cardboard, said inner sieve and said outer sieve traveling generally downward within an angular sector that is in a region of said forming blades, said inner sieve and said outer sieve disposed within said angular sector at one of an angle β of not greater than 10° with respect to one side of a vertical V2, and an angle β' of not greater than 45° with respect to the other side of the vertical V2.

2. The device of claim 1, wherein said angle α is not greater than approximately 10° when said suspension stream is aimed in a slightly upward direction.

3. The device of claim 1, wherein said inner sieve and said outer sieve separate from one another in directions having oppositely directed horizontal components.

4. The device of claim 1, further comprising means for elastically supporting said forming blades which are disposed immediately adjacent to said outer sieve.

5. The device of claim 1, wherein said contact arc ∂ extends from between 10° to 180°.

6. The device of claim 5, wherein said contact arc ∂ extends from between 10° to 100°.

7. The device of claim 1, further comprising means for applying a vacuum pressure to at least one of said sieves in an area not exceeding 10% of an area of said forming blades.

8. The device of claim 1, further comprising a suction device that is located after said forming blades, relative to the running direction of said sieves, and adjacent to said inner sieve, said suction device assisting in separation between said inner and outer sieves.

9. The device of claim 8, further comprising a water container associated with said inner sieve and some of said forming blades, said suction device and said water container being mechanically connected but fluidly separate such that different vacuum pressures may exist in said vacuum device and said water container.

10. The device of claim 1, further comprising means for applying a vacuum pressure within an interior of said roller press.

11. The device of claim 1, wherein the upper layer adheres to said inner sieve where said inner and outer sieves separate.

12. The device of claim 1, wherein said angle $\alpha$ is not greater than approximately 20°.

13. The device of claim 1, wherein said angle $\beta'$ is not greater than approximately 25° with respect to the vertical V2.

14. A device for the production of multiple layered paper or cardboard from a fiber suspention, said device comprising:

a roller press having an outer diameter of at least 800 mm;

means for impinging a stream of the fiber suspension on said roller press at an angle between a vertical V1 and a surface normal N to the suspension stream, said angle being represented by an angle $\alpha$ which is not greater than approximately 60° when the suspension stream is aimed in an upward direction and being represented by an angle $\alpha'$ which is not greater than approximately 90° when the suspension stream is aimed in a downward direction;

a primary longitudinal sieve carrying a lower layer of paper or cardboard; and a double-sieve former for forming an upper layer of the multiple layered paper or cardboard, said double-sieve former including an inner sieve and an outer sieve which are disposed close to one another at a portion thereof and thereafter separate from one another with respect to a running direction of the sieves, said inner sieve carried by said roller press, said inner sieve and said outer sieve each being carried by said roller press with a contact arc $\partial$ which extends from between approximately 10° and 180°, said double-sieve former further including a plurality of forming blades disposed on both sides of said inner sieve and said outer sieve, said forming blades being consecutively beated and alternatingly altering the path of said inner sieve and said outer sieve such that said inner sieve and said outer sieve travel in a zig-zag path with a transverse deflection H of between approximately 0.5 mm to 5.0 mm between said forming blades where both sieves are disposed close to one another, said upper layer adhering to one of the inner sieve and the outer sieve and thereafter being deposited on the lower layer of paper or cardboard, said inner sieve and said outer sieve traveling generally downward within an angular sector that is in a region of said forming blades, said inner sieve and said outer sieve disposed within said angular sector at one of an angle $\beta$ of not greater than 10° with respect to one side of a vertical V2, and an angle $\beta'$ of not greater than 45° with respect to the other side of the vertical V2.

15. The device of claim 14, wherein said forming blades define a travel path therebetween with a curvature in a same direction as curvature of said roller press.

* * * * *

UNITED STATES PATENT AND TRADEMARK OFFICE

CERTIFICATE OF CORRECTION

PATENT NO. : 5,788,816

DATED : Aug. 4, 1998

INVENTOR(S) : Heinz Steckenreuter and Helmut Stoerr

It is certified that error appears in the above-identified patent and that said Letters Patent is hereby corrected as shown below:

Column 3

Line 12, delete "β" and substitute --β'-- therefor.

Signed and Sealed this

Sixth Day of July, 1999

*Attest:*

Q. TODD DICKINSON

*Attesting Officer*

*Acting Commissioner of Patents and Trademarks*